United States Patent [19]

Taylor

[11] 4,063,404

[45] Dec. 20, 1977

[54] BRIDLE BIT SUGAR CUBE HOLDER

[76] Inventor: John D. Taylor, Rte. 3 Box 16, Perryton, Tex. 79070

[21] Appl. No.: 687,418

[22] Filed: May 17, 1976

[51] Int. Cl.[2] ..... B68B 1/06

[52] U.S. Cl. ..... 54/8

[58] Field of Search ..... 54/6–9

[56] References Cited

U.S. PATENT DOCUMENTS

| | | | |
|---|---|---|---|
| 1,091,683 | 3/1914 | Mateer | 54/8 |
| 2,017,021 | 10/1935 | Tepper | 54/7 |
| 2,280,853 | 4/1942 | Rody | 54/7 |

FOREIGN PATENT DOCUMENTS

| | | | |
|---|---|---|---|
| 2,404,007 | 8/1975 | Germany | 54/8 |

*Primary Examiner*—Russell R. Kinsey
*Assistant Examiner*—Peter K. Skiff
*Attorney, Agent, or Firm*—Robert K. Rhea

[57] ABSTRACT

A sugar cube holding device formed with a riding horse bridle bit having a rigid mouthpiece provided with an inverted U-shaped bend medially its ends and having a roller loosely journalled for rotation in opposing directions about the axis of the mouthpiece at the depending limit of the inverted U-shaped bend. A downwardly open hood is placed over the inverted U-shape bend and is rigidly secured thereto to form a downwardly open chamber within the confines of the inverted U-shaped bend. An opening is formed in the rearwardly disposed wall of the hood and is normally closed by a plug after inserting a single cube of sugar into the chamber.

1 Claim, 4 Drawing Figures

BRIDLE BIT SUGAR CUBE HOLDER

BACKGROUND OF THE INVENTION

1. Field of the Invention

The present invention relates to bridle bits for riding horses and more particularly to the mouthpiece of a bridle bit.

Riding horses generally do not readily accept the mouthpiece of the bridle bit particularly in cold weather when the metallic bit is cold. The temperature of the bit can be warmed to some extent by immersing the bit in water before placing the bit in the horse's mouth. However, some horses object to accepting the mouthpiece at any time. Most horses enjoy the taste of sugar, such as sugar cubes, after once having tasted it.

This invention provides a means for holding a cube of sugar within the confines of the structure forming the mouthpiece to induces horses to readily accept the mouthpiece.

2. Description of the Prior Art

Prior art patents, for example, U.S. Pat. Nos. 509,968 and 617,583, generally disclose bridle bit mouthpieces for receiving liquid medicine for treating the horse's mouth and throat while using the bit.

SUMMARY OF THE INVENTION

The invention employs a bridle bit having parallel rigid cheek plates rigidly interconnected in parallel spaced relation by a rod-like mouthpiece, the mouthpiece having an inverted U-shaped bend medially its ends and including a roller loosely journalled for angular rotation about the axis of the opposing straight end portions of the mouthpiece by the tongue of a horse. A downwardly open housing or hood is placed over the inverted U-shaped bend in the mouthpiece to form a downwardly open chamber within the confines of the U-shaped bend. The rearwardly disposed wall of the hood is provided with an opening having a diameter permitting free passage of a single cube of sugar into the chamber. The roller supports the sugar cube within the chamber with the opening being closed by a removable plug.

The principal object of the invention is to provide a bridle bit with means for holding a sugar cube as an inducement in training a horse to readily accept the bridle bit mouthpiece into his mouth and as an inducement for the horse to be easily caught in a corral or in the field by a person on foot.

DESCRIPTION OF THE PREFERRED EMBODIMENTS

Figure 1:
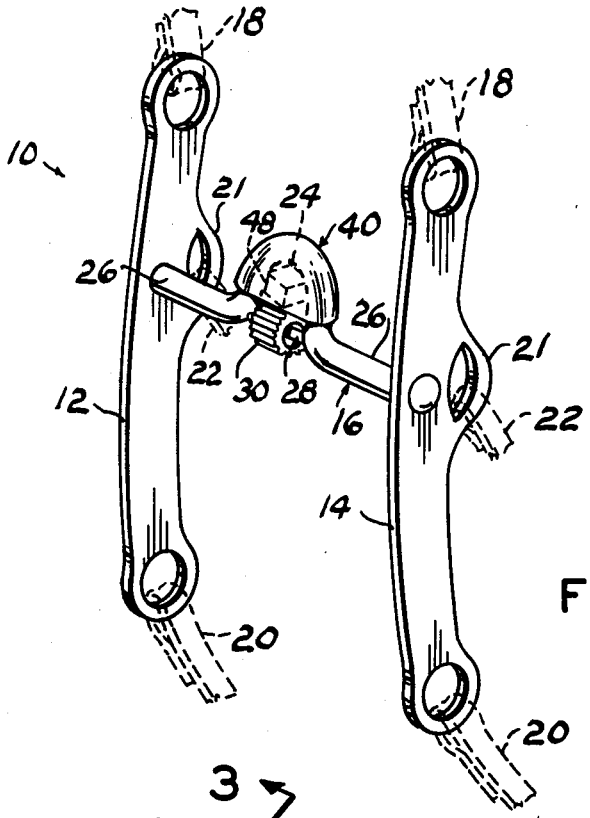
FIG. 1 is perspective view of a bridle bit having the invention installed thereon and illustrating, by dotted lines, the relative position of a sugar cube and bridle component fragments connected with the respective bridle cheek plate.

Like characters of reference designate like parts in those figures of the drawings in which they occur.

In the drawings:

The reference numeral 10 indicates a riding horse bridle bit comprising a pair of strap metal cheek plates 12 and 14 rigidly interconnected in spaced-apart relation by a normally horizontal mouthpiece 16. The respective ends of the cheek plates 12 and 14 are provided with rings or apertures for receiving bridle cheek straps 18 and reins 20, respectively. Intermediate their respective ends, the cheek plates 12 and 14 are provided with a rearwardly directed arcuate apertured projection 21 for receiving the respective end of a curb or chin strap 22. The mouthpiece 16 is rod-like in transverse section and is formed intermediate its ends to define a substantially inverted U-shape 24 and oppositely disposed axially aligned mouthpiece end portions 26. Opposing surfaces of the mouthpiece inverted U-shaped portion 24 thus form forward and rearward surfaces parallel with the mouthpiece end portions 26 when the mouthpiece is placed in a horse's mouth, not shown. A pin or rod 28, having a diameter less than the mouthpiece end portions 26, extends coaxially between the end portions 26 in bridging relation with respect to the opening of the U-shaped portion opposite its bight portion. A roller 30, having a serrated periphery, is freely journalled for angular rotation about the axis of the rod 28. The above description is conventional with riding horse bridle bits and is set forth to disclose structure with which the invention is to be used.

Figure 2:
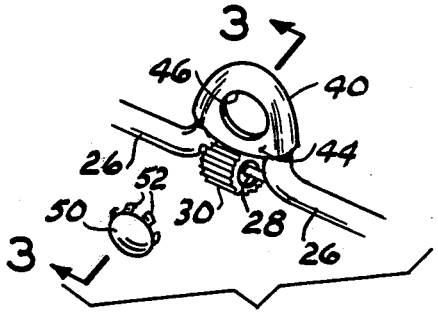
FIG. 2 is a fragmentary perspective view of the medial portion of the bridle bit mouthpiece from the opposite side of that shown in FIG. 1 illustrating the plug in exploded relation.
Figure 3:
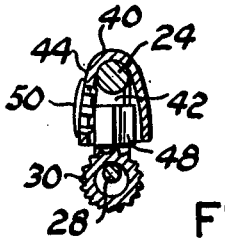
FIG. 3 is a vertical cross sectional view taken substantially along the line 3—3 of FIG. 2 illustrating the plug in sugar cube retaining position; and, FIG. 4 is a view similar to FIG. 3 illustrating an alternative embodiment and omitting the sugar cube.

In carrying out the invention and referring more particularly to FIGS. 1 to 3, a downwardly open one piece hood 40, formed of thin wall metallic material, is disposed in overlying contiguous contacting relation with respect to the inverted U-shaped portion 24 thus forming a downwardly open chamber 42 (FIG. 3). The depending edge of the hood wall preferably lies in a substantially horizontal plane tangent to the periphery of the roller 30. The rearwardly disposed wall 44 of the hood is provided with an opening 46 dimensioned to permit passage of a cube of sugar 48 into the chamber 42. The opening 46, after inserting the cube of sugar 48, is closed by a plug 50 having resilient fingers 52 for retaining the plug in place. The roller 30, supported by the rod 28, prevents the sugar cube 48 from falling by gravity out of the chamber 42.

Figure 4:
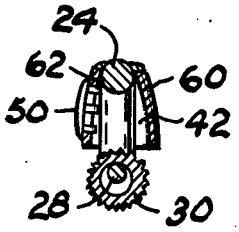

Referring more particularly to FIG. 4, an alternative embodiment is illustrated in which the opening, formed by the U-shaped portion 24, is closed by a pair of forward and rearward arcuate plates 60 and 62, respectively, each having a substantially U-shaped edge surface complemental with the U-shaped portion 24. Each of the plates 60 and 62 are secured along their arcuate edges to the respective forward and rearward surface of the mouthpiece inverted U-shaped portion to similarly form the downwardly open chamber 42. The rearward plate 62 is provided with an opening which removably receives the plug 50.

OPERATION

In operation, prior to bridling a horse, the sugar cube 48 is placed within the receptacle 42, as described hereinabove. With the mouthpiece 16 in place within the horse's mouth and a bridle strap on the horse's head, in a well known manner, the saliva in the horse's mouth begins dissolving the cube of sugar. Dissolving of the sugar cube is enhanced by the horse moving his tongue upwardly and downwardly against the roller 30 which revolves and by its serrations grind off portions of the sugar cube. Being fed a sugar cube each time the horse is bridled induces the horse to readily accept the mouthpiece into his mouth.

Obviously the invention is susceptible to changes or alterations without defeating its practicability. Therefore, I do not wish to be confined to the preferred embodiment shown in the drawings and described herein.

I claim:

1. In combination with a bridle bit having a rigid mouthpiece characterized by axially aligned normally horizontal opposing end portions and an inverted substantially U-shaped bend medially its length having a forward surface and a rearward surface and having a roller journalled for rotation about the axis of a pin horizontally bridging the spacing between the mouthpiece opposing end portions, the improvement comprising:

a hood overlying and secured to the inverted U-shaped bend of said mouthpiece and having a depending wall edge lying in a plane tangent with the upper limit of said roller for defining a downwardly open article receiving chamber within the U-shaped bend above said roller, the wall of said hood having an opening diametrically dimensioned for the passage of a cube of sugar, or the like, and communicating with the chamber; and, a plug for opening and closing the hood wall opening.

* * * * *